United States Patent [19]

Johnson

[11] 4,398,538

[45] Aug. 16, 1983

[54] WOMENS SOFT FABRIC GARMENT WITH INTEGRAL BRASSIERE

[75] Inventor: Christina E. Johnson, Los Angeles, Calif.

[73] Assignee: Olga Company, Van Nuys, Calif.

[21] Appl. No.: 346,484

[22] Filed: Feb. 8, 1982

[51] Int. Cl.[3] ..... A41C 1/06; A41C 3/00; A41D 5/00

[52] U.S. Cl. ..... 128/432; 2/67; 128/425

[58] Field of Search ..... 2/67, 432, 425, 455, 2/73; 128/454, 491, 489

[56] References Cited

U.S. PATENT DOCUMENTS

| | | | |
|---|---|---|---|
| 1,566,267 | 12/1925 | Bee | 2/78 R |
| 2,225,721 | 12/1940 | Solomon | 128/432 |
| 2,700,160 | 1/1955 | Scholfield | 128/455 |
| 3,022,914 | 2/1962 | Garson | 128/455 |
| 3,237,206 | 3/1966 | Wright | 2/74 |
| 3,422,818 | 1/1969 | Erteszek | 128/454 |

*Primary Examiner*—Doris L. Troutman
*Attorney, Agent, or Firm*—William W. Haefliger

[57] ABSTRACT

A women's garment includes (a) a bodice having a soft fabric front portion to conform to the bust of the wearer, (b) an elastic band spaced inwardly from the bodice and located in a loop shaped path adapted to extend about the body of the wearer so as to tension the band, (c) and a fabric panel attached to the bodice above the level of the band and suspending the band to extend crosswise of said bodice soft fabric front portion so that when tensioned the band will anchor a front panel portion of the fabric panel beneath and in supporting relation to the bust of the wearer.

12 Claims, 10 Drawing Figures

WOMENS SOFT FABRIC GARMENT WITH INTEGRAL BRASSIERE

BACKGROUND OF THE INVENTION

This invention relates generally to women's garments having associated brassieres, and more particularly concerns a self-adjusting bust fitting and supporting structure independently suspended within and by an outer garment which closely fits the body of the wearer.

Prior garments have had brassiere cups attached to the bodice of the outer garment structure, so as to be built into the latter; however, no way was known to provide a simple, lightweight brassiere structure freely suspended from thin, lightweight outer garment panels but adjustable independently thereof, and in the manner of the present invention, thereby to provide extreme comfort as well as other advantages as will be seen.

SUMMARY OF THE INVENTION

It is a major object of the invention to provide an attractive, lightweight garment structure meeting the above need. Basically it incorporates:

(a) a bodice having a soft fabric front portion to conform to the bust of the wearer, (b) an elastic band spaced inwardly from the bodice and located in a loop shaped path adapted to extend about the body of the wearer so as to tension the band, (c) and a fabric panel attached to the bodice above the level of the band and suspending the band to extend crosswise of said bodice soft fabric front portion so that when tensioned the band will anchor a front panel portion of the fabric panel beneath and in supporting relation to the bust of the wearer.

As will be seen, the elastic band suspending panel includes a front portion consisting of soft fabric adapted to independently conform to the bust of the wearer, inwardly of the bodice front portion. Further, the length of the unstretched band loop is substantially less than the unstretched body girding length of the outer garment panels (outwardly of the band) whereby the band tends to grip the body more tightly than the stretchable outer garment, whereby the bust area is comfortably supported independently of movement of the outer garment relative to the body of the wearer, as will be seen.

These and other objects and advantages of the invention, as well as the details of an illustrative embodiment, will be more fully understood from the following description and drawings, in which:

DRAWING DESCRIPTION

Figure 2:
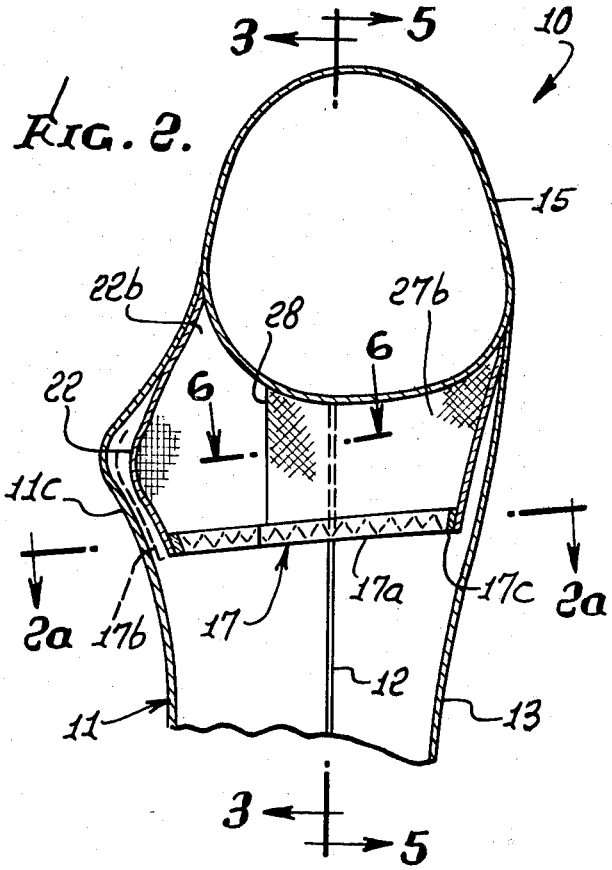
FIG. 2 is an enlarged vertical section looking sidewardly through an upper portion of the garment, on lines 2—2 of FIG. 1
Figure 2A:
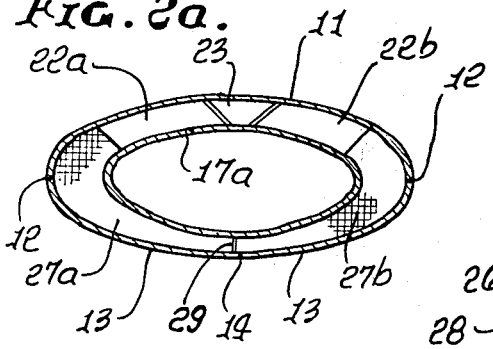
Figure 3:
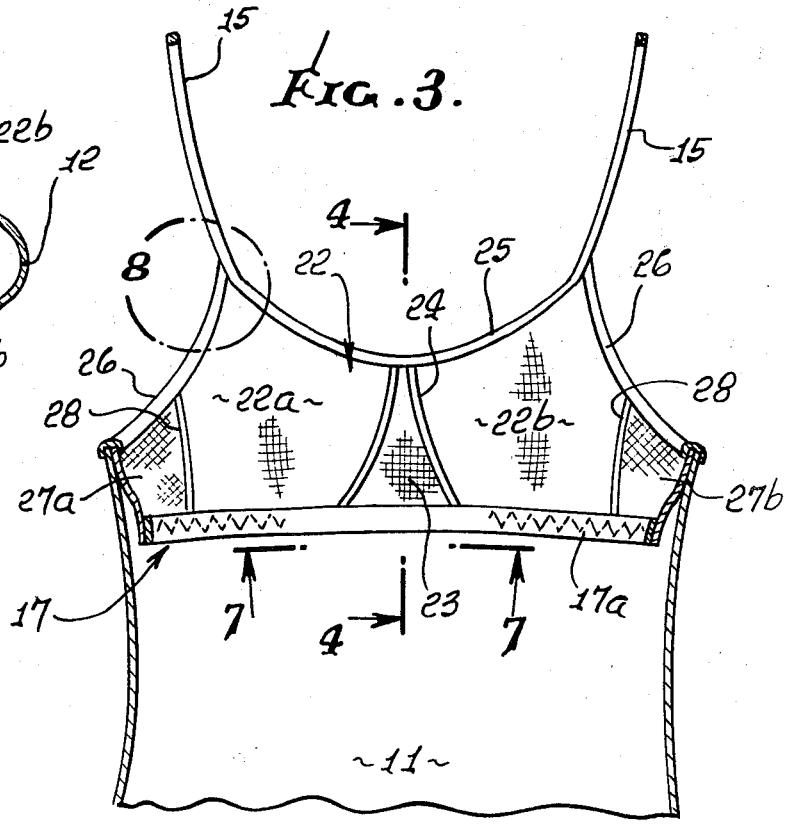
Figure 5:
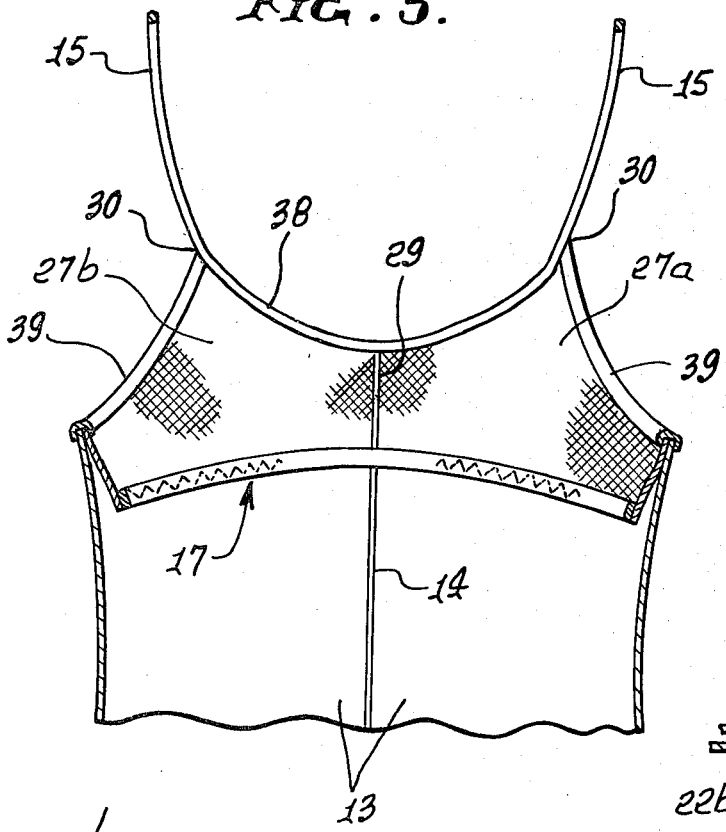
Figure 4:
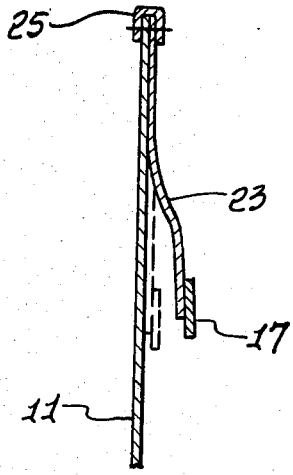
Figure 6:
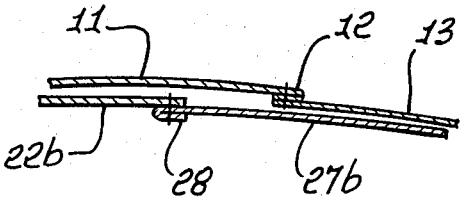
Figure 7:
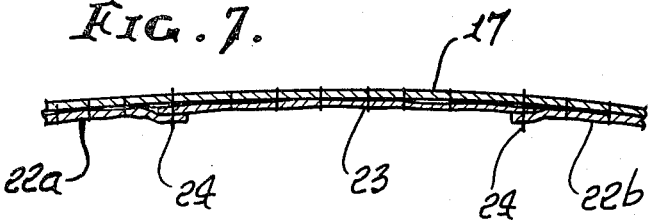
Figure 8:
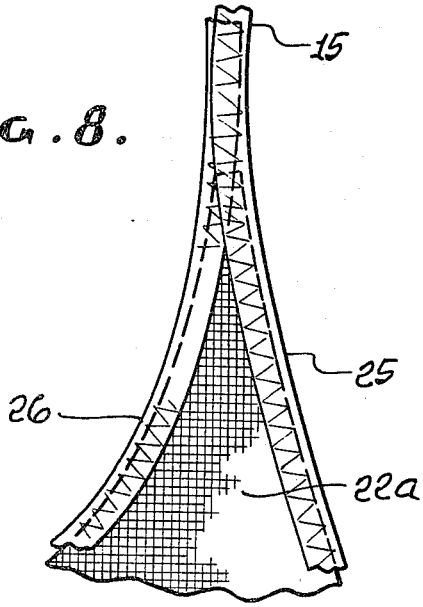

FIG. 2*a* is a section on lines 2*a*—2*a* of FIG. 2;

FIG. 3 is a frontwardly looking vertical section taken on lines 3—3 of FIG. 2;

FIG. 4 is an enlarged fragmentary vertical section on lines 4—4 of FIG. 3;

FIG. 5 is a vertical section looking rearwardly on lines 5—5 of FIG. 2;

FIG. 6 is an enlarged framentary section on lines 6—6 of FIG. 2;

FIG. 7 is an enlarged fragmentary section on lines 7—7 of FIG. 3;

FIG. 8 is an enlarged view showing details within circle 8 in FIG. 3; and

Figure 9:
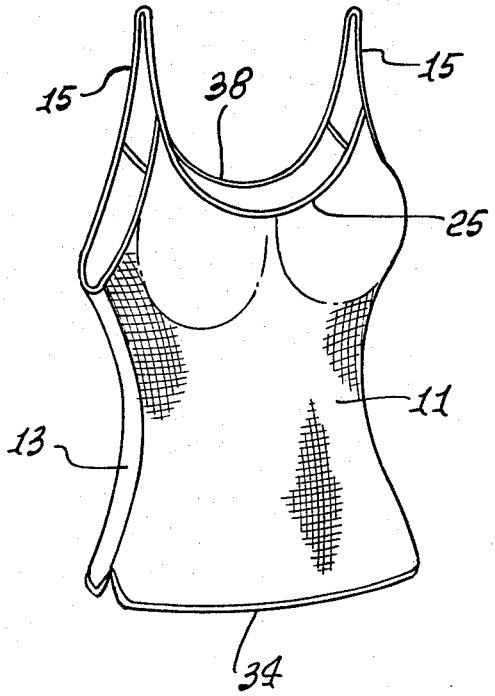

FIG. 9 is a perspective view of another form of undergarment embodying the invention.

DETAILED DESCRIPTION

In the drawings, an outer garment 10, such as a body suit is shaped to closely fit to a female torso. It may include a front panel 11 attached at vertical side seams 12 to two rear panels 13, which are themselves secured together at vertical back seam 14. The garment has elastically yieldable shoulder straps 15 supporting upwardly tapering extents 11*a* of the panels 11, and upwardly tapering extents 13*a* of the panels 13. Panels 11 and 13 also define upper thigh openings 16, bounded by looping strips 20 such as seam bias tape, sewn to the panel lower extents. The latter also define a detachable crotch piece or pieces 30 having associated suitable snap or hook fasteners 31. The garment panels 11 and 13 typically consist of soft, thin, lightweight, pliable, and two-way elastically stretchable fabric such as interwoven cotton and polyester yarn, this being one example only.

In accordance with an important aspect of the invention, an elastic band is spaced inwardly from a bodice 11*c* defined by the upper portion of panel 11, that bodice adapted to closely conform to the bust of the wearer due to elastically stretchable or yieldable characteristics of the panel fabric. The illustrative elastic band 17 extends generally horizontally at the bust region and in a loop shaped path so as to extend at least partly, and preferably completely about the body of the wearer, thereby to tension the band. To this end, the length of the unstretched, wavy loop 17*a* along which the band extends is substantially less than the body girding or bounding unstretched length of the sections garment panels 11 and 13 outwardly of the loop 17*a*, as prior to fitting or application of the garment onto the body of the wearer, as is clear from FIG. 2*a*. Accordingly, since the panels 11 and 13 are stretched when the garment is fitted onto the wearer's body, the elastic band 17 is stretched to substantially greater extent, when so fitted.

Note in FIG. 2 that the front extent of the band is adapted to fit (see broken lines 17*b*) and be stretched under the wearer's bust region to provide comfort and support; and that the rearward extent of the loop 17*a*, which may be defined by rearward extent 17*c* of band, fits the back of the wearer at substantially the same elevation as the front extent 17*b*, Further in accordance with the invention, a fabric panel is attached to the bodice above the level of the band, and freely suspends the band to extend crosswise of the bodice soft fabric front portion and thereby to adjust to the wearer's body independently of the outer panels 11 and 13. See for example the fabric panel front portion 22 that includes left and right panel sections 22*a* and 22*b* in FIGS. 2 and 3 which typically have two-way yieldable stretch characteristics and are adapted to conform to fit the bust of the wearer. Also, they are preformed or pre-stretched to have breast cups configuration. Sections 22*a* and 22*b* typically may consist of the same soft fabric as outer panels 11 and 13; and may also incorporate a yieldably stretchable material such as LYCRA. The percentages may be about 46% cotton; about 46% polyester; and about 8% LYCRA, or equivalents. The fabric panel that suspends the elastic band may also include a delta shaped panel section 23 intermediate sections 22a and 22b, and sewn thereto at 24. Section 23 is typically non-stretchable so as to be held inwardly, by band 17, intermediate the busts of the wearer. The front panel portions 22a, 22b and 23 are shown as attached to and suspended from elastically yieldable tapes 25 and 26 at the top of the garment outer panels, and that taper upwardly to meet the shoulder straps.

The band-suspending panel may also advantageously include rear panel portions 27a and 27b shown in FIG. 5, and which also extend at the inner sides of the garment, and laterally, to merge with and join the front panel portions 22a and 22b along seams 28, as is clear from FIG. 3. Panel portions 27a and 27b merge at seam 29 at the inner and rear side of the garment, and they typically consist of sheer net fabric (for example NYLON) which is stretchable, but less so than the fabric of front panel portions 22a and 22b. Note that rear panel portions 27a and 27b are attached to and freely suspended from bias tape 38 at the upper edge of garment outer panels 13, that tape and side tapes 39 merging with upward taper to meet the shoulder straps at 30.

FIG. 9 shows a body fitting garment the same as seen in FIGS. 1–8, except that panels 11 and 13 terminate downwardly at a level defined by bias tape 34, located just below the waist region. Thus, a loose skirt is formed by the panels 11 and 13.

From the foregoing, it will be seen that the total garment defines a comfortably fitting outer garment wherein a brassiere with pre-formed soft cups is suspended to independently and comfortably adjust to and support the figure of the wearer.

Figure 1:
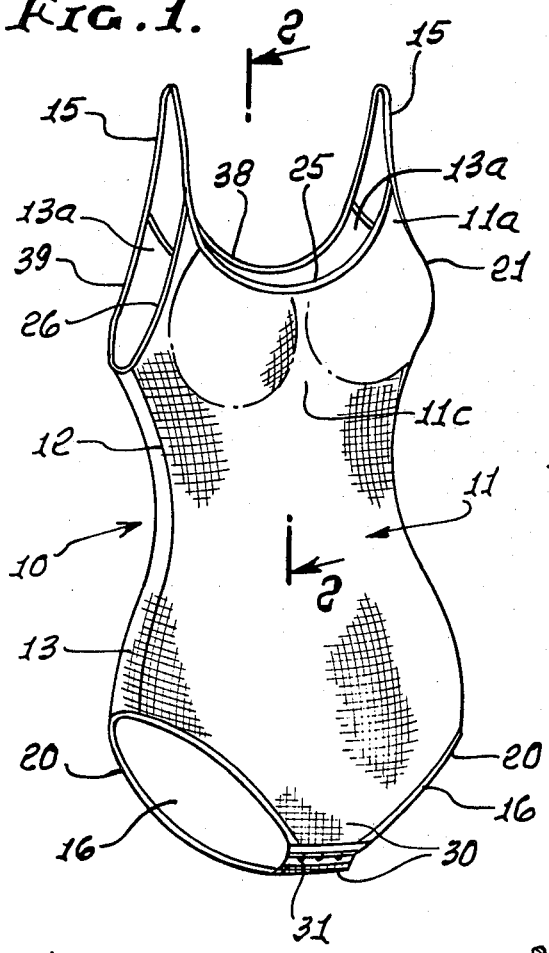
FIG. 1 is a perspective view of an undergarment in which the invention is embodied.

In FIGS. 1, 2 and 3, the outer panels 11 and 13 are shown as if fitted to the body of the wearer; however, the band 17 and supporting panels 22 and 27 are shown in solid lines as independently suspended prior to fitting to the figure of the wearer.

I claim:

1. In a women's garment, the combination comprising (a) a bodice having a soft fabric front portion which is elastically stretchable to conform to the bust of the wearer, (b) an elastic band spaced inwardly from the bodice and located in a loop shaft path everywhere free of attachment to the bodice and adapted to extend substantially completely about the body of the wearer so as to tension the band, (c) and a fabric panel attached to the bodice above the level of the band to downwardly hang free of the bodice and freely suspending the band to extend crosswise of said bodice soft fabric front portion so that when tensioned the band will anchor a front panel portion of the fabric panel beneath and in supporting relation to the bust of the wearer, (d) said band suspending panel including a front portion having left and right sections each consisting of soft, two-way stretchable fabric with breast cup configuration adapted to independently conform to the bust of the wearer, inwardly of said bodice soft elastically stretchable fabric front portion of the bodice, said sections being free of attachment to said front portion of the bodice.

(e) and a tape-like insert extending upwardly from the band medially of said front panel portion and connected therewith, said insert being non-stretchable, and an elastically stretchable tape extending crosswise above said insert and from which said panel front portion left and right sections and said bodice front portion are suspended.

2. The combination of claim 1 wherein said fabric panel includes a rear panel portion adapted to extend at the back of the wearer's body.

3. The combination of claim 2 wherein said rear panel portion consists of sheer fabric which is less stretchable than said panel front portion fabric.

4. The combination of claim 3 wherein said rear panel portion consists of NYLON or the like.

5. The combination of claim 1 wherein the bodice soft fabric front portion comprises interwoven cotton and polyester yarn.

6. The combination of claim 5 wherein the front panel portion of the fabric suspension comprises interwoven cotton, polyester yarn, and LYCRA, or equivalents.

7. The combination of claim 1 wherein the garment includes shoulder straps, said fabric panel tapering upwardly at four locations toward lowermost extents of said shoulder straps.

8. The combination of claim 1 wherein the garment includes front and rear, outer stretchable panel structure defining the bodice.

9. The combination of claim 1 wherein the length of the unstretched loop is substantially less than the unstretched body girding length of said front and rear outer panel structure.

10. The combination of claim 9 wherein the band has a front portion at an elevation to provide bust support when stretched by the body of the wearer, and a rear portion to extend at the back of the wearer.

11. The combination of claim 8 wherein said outer panel structure defines leg thigh openings.

12. The combination of claim 8 wherein said outer panel structure defines a skirt below waist level.

* * * * *